US007877918B2

(12) United States Patent
Garavaglia

(10) Patent No.: US 7,877,918 B2
(45) Date of Patent: Feb. 1, 2011

(54) MULTI-SHOT FIREARM USING SEPARATE CHAMBER TUBES

(76) Inventor: Louis Garavaglia, 3501 Cordgrass Ct., Melbourne, FL (US) 32934

( * ) Notice: Subject to any disclaimer, the term of this patent is extended or adjusted under 35 U.S.C. 154(b) by 644 days.

(21) Appl. No.: 11/974,926

(22) Filed: Oct. 16, 2007

(65) Prior Publication Data

US 2011/0000117 A1 Jan. 6, 2011

Related U.S. Application Data

(60) Provisional application No. 60/851,877, filed on Oct. 16, 2006.

(51) Int. Cl.
*F41A 9/61* (2006.01)

(52) U.S. Cl. ..... 42/6; 42/7; 42/39.5; 42/49.01

(58) Field of Classification Search ..... 42/15, 42/23, 24, 7, 6, 49.01, 50; 89/33.03, 155
See application file for complete search history.

(56) References Cited

U.S. PATENT DOCUMENTS 672,300 A * 4/1901 Turnbull ..... 42/39.5
3,270,455 A * 9/1966 Smernoff et al. ..... 42/1.15
3,706,259 A 12/1972 Ashley et al.
4,426,802 A * 1/1984 Walker ..... 42/59
H61 H * 5/1986 Yuhash et al. ..... 42/39.5
4,709,496 A * 12/1987 Johnson ..... 42/70.11
5,036,611 A 8/1991 Schmid
5,299,373 A * 4/1994 Breiner ..... 42/39.5
5,761,841 A * 6/1998 Snick ..... 42/50
7,137,217 B2 11/2006 Olson et al.

* cited by examiner

*Primary Examiner*—Stephen M Johnson
*Assistant Examiner*—Daniel J Troy
(74) *Attorney, Agent, or Firm*—John R. Benefiel

(57) ABSTRACT

A firearm includes a magazine cavity in a handle defined by a frame. A stack of chamber tubes each holding a cartridge is loaded into the magazine cavity. A firing recess just to the rear of a bore defined in a firearm barrel receives the topmost chamber tube and cartridge and is urged against a partially circular contour defined within the recess by a feed spring which contour center is aligned with the bore. Each cartridge is fired while in its chamber tube by a firing mechanism and each chamber tube and fired cartridge are both ejected by gas pressure exerted on one side of the chamber tube through an ejection port defined by an opening in one side of the firing recess remote from the one side of the chamber tube. The ejection port allows a chamber tube positioned therein to be readily viewed or felt through the ejection port to make it possible to easily and reliably determine if the firearm is ready to be fired.

6 Claims, 1 Drawing Sheet

MULTI-SHOT FIREARM USING SEPARATE CHAMBER TUBES

CROSS REFERENCE TO RELATED APPLICATIONS

This application claims the benefit of U.S. provisional application No. 60/851,877 filed on Oct. 16, 2006.

FIELD OF THE INVENTION

The present invention relates to firearms; specifically, it relates to a simple, safe and compact multi-shot firearm for self defense.

DESCRIPTION OF THE PRIOR ART

In recent years, the purchase of small handguns for self defense by people generally unfamiliar with firearms has increased. The vast majority of handguns purchased are semi-automatic pistols rather than revolvers, largely because of their flat, compact configuration. However, such pistols can pose a threat to unskilled users. First, a simple glance will not reveal whether most such pistols are loaded; they must be manually manipulated to ascertain this, and the manipulation itself can lead to accidents. If the magazine is removed for safety reasons, a cartridge may still remain in the chamber, and later be fired unintentionally by someone unaware of the chambered cartridge. If the slide is opened to inspect the chamber while a loaded magazine is in place, closing the slide will force a cartridge into the chamber, again making accidental discharge possible.

It is an object of the present invention to provide a flat, compact pocket pistol, with a capacity of five or six cartridges, which is inherently safe and simple in operation.

SUMMARY OF THE INVENTION

The above object and others which will become apparent upon a reading of the following specification is achieved by pistol in which it can readily be seen if the pistol has a round in position to be fired without the need to manipulate it, because a round in firing alignment is always exposed to view via a side ejection port. A pistol according to the invention has no reciprocating slide as in a conventional semi-auto pistol, and no rotating cylinder as in a conventional revolver. In fact, its only mechanisms comprise a firing mechanism, and a magazine spring and follower. Such simplicity is possible because each cartridge is housed in its own chamber tube, which functions as a conventional chamber normally defined in the pistol frame. Since each cartridge is fired when in its chamber tube which is automatically ejected with the casing, no chambering, extraction or ejection mechanism is required. Thus, each chamber tube is designed to be of ample strength to withstand the radial pressure generated by the cartridge when fired within the chamber tube.

The chamber tubes each have a conventional rimfire or centerfire cartridge loaded therein, and rest one on top of another in a hollow pistol grip magazine to form a stack, and are continuously pressed upward by a spring and follower, the whole arrangement similar to that of magazines in semi-auto pistols. The topmost tube is seated in a firing recess which is open to one side to be clearly visible. In this position it is located in alignment with the pistol bore and ready for firing.

The top chamber tube aligned with the pistol bore and ready for discharge is easily visible through the open side of the firing recess. In darkness, a touch of the fingertip through the open side will make one instantly aware whether or not a chamber tube is in firing alignment. The chamber tubes maybe brightly colored, and/or otherwise marked with warning symbols.

When the pistol is fired, some of the gas is designed to escape between the front end of the chamber tube and the rear face of the barrel, and forces itself between the chamber tube and the rear face of the barrel into which the bore extends and also between one side of the chamber tube and a sidewall of the recess opposite the side of the firing recess. Thus the chamber tube and its expended cartridge case are automatically ejected by the gas pressure out through the open side of the firing recess which thereby functions as an ejection port. The next chamber tube being urged upwardly by the magazine spring, automatically rises into the firing recess in alignment with the bore and ready for firing.

BRIEF DESCRIPTION OF THE DRAWINGS

The present invention will be more fully understood by reference to the attached drawings, wherein.

DESCRIPTION OF A PREFERRED EMBODIMENT

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
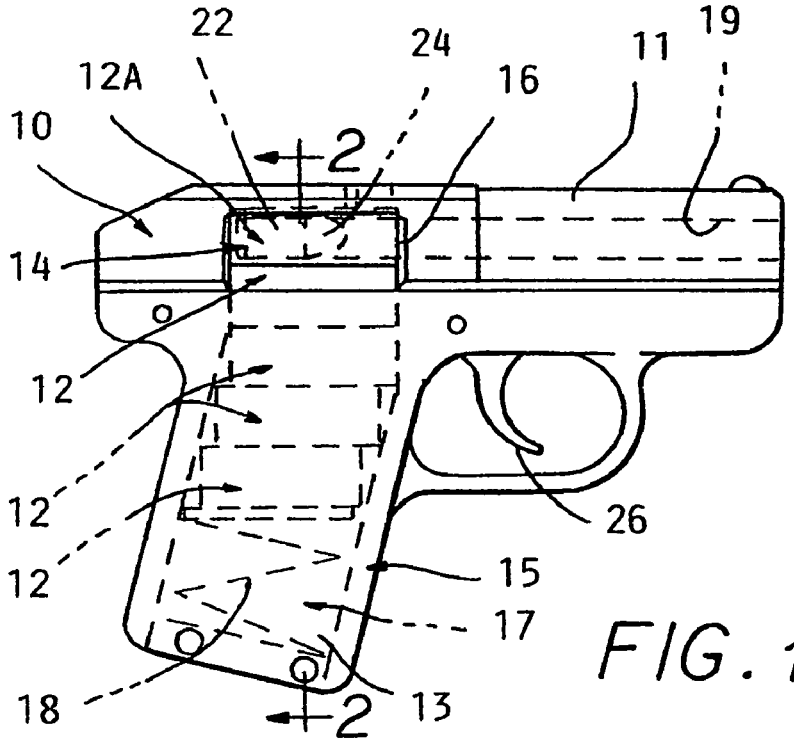
FIG. 1 is a view of the right side of the pistol.

As seen in FIG. 1, a pistol according to the invention comprises a frame 10, which includes a barrel 11, a side plate 13 and grip or handle 15. The handle 15 is hollow, having a cavity 17 which covered by the side plate 13 and comprising a magazine for holding a stack of open ended separately movable chamber tubes 12, each of which is loaded with a cartridge 22 of conventional ammunition. The stack of chamber tubes 12 is urged upwardly by a spring and follower assembly 18, to successively move each chamber tube 12 into alignment with a bore 19 in the barrel 11 as each cartridge 22 is fired and ejected with its chamber tube 12 as described below.

Figure 2:
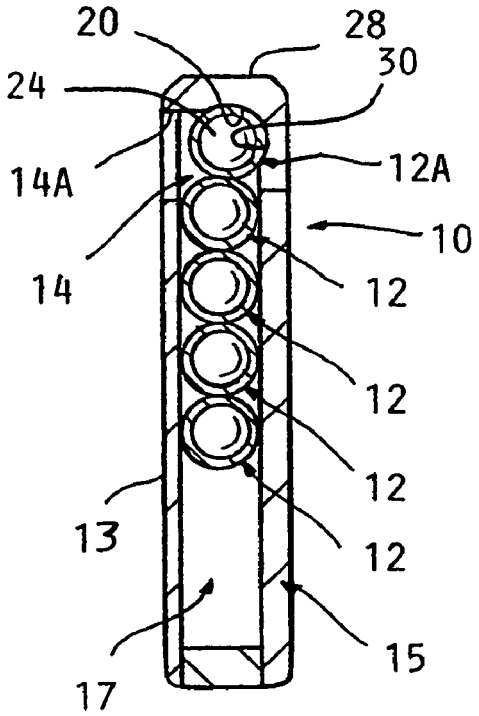
FIG. 2 is a view of a section taken through the pistol along the vertical line 2-2 in FIG. 1.
Figure 3A:
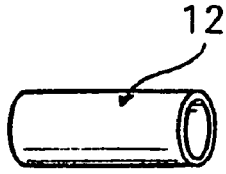
FIG. 3A is a pictorial external view of a chamber tube.
Figure 3B:
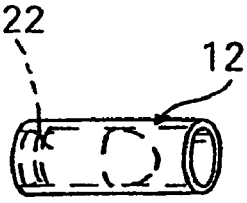
FIG. 3B is a pictorial view of a chamber tube showing a cartridge loaded therein in hidden lines.

The top chamber tube 12A is held in a firing recess 14 aligned with the bore 19 of the barrel 11. The top chamber tube 12A is held located in the aligned position, as seen in FIG. 2, by being urged against the top inside surface 20 of the frame wall 28 defining the firing recess 14 by the next below chamber tube 12. The surface 20 is a partially circular contour with a radius centered on the bore 19. The off-center location of the other chamber tubes 12 in the magazine 17 creates an angled contact force which forces the topmost chamber tube 12A and housed loaded-cartridge 22 upwardly and to the right as viewed in FIG. 2, seated against the contoured surface 20. As mentioned, the circular contour 20 has a radius is centered on the bore 19 to thereby align the bullet 24 therewith.

Firing is effected by a conventional hammer and trigger mechanism (not shown in detail), or striker and trigger 26, both well known in the art which when the trigger 26 is squeezed, causes a firing pin (not shown) to be driven against the base of the cartridge 22. Upon firing, the bullet 24 leaves the expended cartridge case in the chamber tube 12A and enter the bore 19 of the barrel 11. As it does so, some of the high pressure gas generated by the discharge leaks from a small space 16 between the front face of the chamber tube 12A and the rear face of the barrel 11. While the bullet 24 is passing through the bore 19, a portion of the gas flowing through the clearance 16 forces itself between the side of the body of the chamber tube 12A and the right side wall surface 30 of the frame 10 defining in part the firing recess 14, as seen in FIG. 2. Thus, the pressure of the gas may force its way to the right side of the chamber tube 12A remote from the firing recess side having the opening 14A therein (the left side in FIG. 2). The gas pressure acting on the one side ejects the chamber tube 12A and its expended cartridge case through the opening 14A on one side of the firing recess 14 which opening 14A thus functions as an ejection port (as well as a loading and inspection port).

To minimize the bullet's loss of velocity from gas leakage, the chamber tubes 12 are made to be as long as practical i.e., 1⅜", or 35 mm, for example, and the bore 19 has a comparatively long freebore at its breach end.

Once the top chamber tube 12A containing a fired case is ejected through the ejection port defined by the opening 14A on one side of the firing recess 14, the next chamber tube 12 below containing its unfired cartridge 22 moves into the firing recess 14 and abuts contour 20 to be in alignment with the bore 19 to ready the pistol for another shot. The chamber tubes 12 may be collected and reused many times.

Thus, a simple firearm comprising semiautomatic pistol is provided which allows easy detection of the presence of a round in a position ready to be fired, either visually or by inserting a fingertip into the recess 14. This design can also be used with a grenade launcher or shotgun.

The invention claimed is:

1. A firearm comprising:

a frame defining an open topped magazine cavity;

a stack of separately movable open ended chamber tubes each loaded with a cartridge, said stack of open ended chamber tubes held in said magazine cavity, with a feed spring urging said stack of chamber tubes upwardly therein;

a firing recess defined in said frame aligned with the open top of said magazine cavity, said firing recess configured to receive therein a topmost chamber tube in said stack urged upwardly by said feed spring;

said frame also including a barrel with a bore therein aligned with said firing recess;

a topmost chamber tube in said stack held against a contoured surface defining in part said firing recess by the urging of said feed spring, said firing recess having an opening on one side configured to define an ejection port for ejection of said chamber tubes as well as exposing said topmost chamber tube therein to view and allowing touching contact so as to allow an easy and reliable determination if the firearm is ready to fire; a space allowing high pressure gas generated by firing a cartridge to be directed against a side of said topmost chamber tube remote from the side of said firing recess having said opening therein to force said topmost chamber tube containing an empty cartridge casing and out through said opening on one side of said firing recess to thereby be automatically ejected from said firearm after firing of said cartridge loaded therein; and a firing mechanism for selectively firing a cartridge in the topmost chamber tube located in said firing recess.

2. The firearm according to claim 1 wherein said space includes a gap between an end of said topmost chamber tube in said recess and an adjacent end of said bore.

3. The firearm according to claim 1 wherein said recess a contoured surface is partially circular and centered with said bore and engaged by the topmost chamber tube which is thereby aligned with said bore, whereby the topmost chamber tube is aligned with said bore when seated against said contoured surface.

4. The firearm according to claim 1 wherein said chamber tubes are brightly colored to be readily visible through said opening in said one side of said firing recess when each chamber tube is positioned in said firing recess.

5. The firearm according to claim 1 wherein each of said chamber tubes is substantially longer than said cartridge held therein.

6. The firearm according to claim 1 wherein said contoured surface is offset from the remaining chamber tubes in said stack whereby said feed spring acting on said stack of chamber tubes urges said topmost chamber tube to the side remote from said firing recess opening and upwardly against said partially circular contoured surface.

* * * * *